US005538122A

United States Patent [19]

Siemens

[11] Patent Number: 5,538,122

[45] Date of Patent: Jul. 23, 1996

[54] CURRENCY RECEIVING DEVICE

[75] Inventor: John Siemens, Nobleton, Canada

[73] Assignee: Namsys Inc., Bolton, Canada

[21] Appl. No.: 240,421

[22] Filed: May 10, 1994

[51] Int. Cl.[6] ..... G07F 7/04

[52] U.S. Cl. ..... 194/207; 271/215

[58] Field of Search ..... 194/206, 207; 271/215, 217

[56] References Cited

U.S. PATENT DOCUMENTS

| | | | |
|---|---|---|---|
| 3,107,912 | 10/1963 | Fiehl | 271/215 |
| 4,189,133 | 2/1980 | Arrasmith et al. | 271/217 X |
| 4,744,468 | 5/1988 | Goi et al. | 194/206 X |

FOREIGN PATENT DOCUMENTS

| | | | |
|---|---|---|---|
| 87/02808 | 5/1987 | WIPO | 271/217 |

*Primary Examiner*—F. J. Bartuska

[57] ABSTRACT

A currency receiving device is disclosed which comprises a safe, having a lockable access opening and a lockable currency receiving opening, a removable currency receptacle contained within the safe and positioned to receive currency through the currency receiving opening, a currency counter for counting and identifying currency received and placing the currency in a position to pass through the currency receiving opening, and a controller which governs the opening and closing of the currency receiving opening. Currency inserted into the currency counter is deposited on top of a panel which covers the currency receiving opening. If it is desired to deposit the currency into the safe, an operator engages a microprocessor controller causing the currency to be deposited onto a moveable platform within the currency receptacle. The platform is simultaneously lowered to allow further currency to be deposited. When desired, the currency receptacle can be removed from the safe and transported to another location.

22 Claims, 5 Drawing Sheets

CURRENCY RECEIVING DEVICE

FIELD OF THE INVENTION

This invention relates to currency receiving devices and more particularly currency receiving devices having a currency counter and a removable currency receptacle contained within a safe.

BACKGROUND OF THE INVENTION

Many devices have been developed for the secure storage of currency. Typically such devices, referred to generally "safes", comprise a reinforced container having a lockable access door. Most safes are constructed of heavy gauge or hardened steel, although sometimes they may be constructed of other materials including concrete. Typically such safes have a single access door having either internal or heavily reinforced hinges and a sturdy locking mechanism; most often of the tumbler or combination type.

Safes or currency receiving devices of this type are useful for the secure storage of currency and valuable documents. However, they suffer from the inherent limitation that their access doors have to either be left open or continually opened and closed in situations where numerous deposits of currency are made over a short time span. For example, in applications in financial institutions where money is continually being deposited and must be securely stored, safes of the type described are overly cumbersome. Since numerous deposits of currency into the safe are made throughout the day, banking personnel often tend to leave the access door open rather than locking and unlocking the door each time a new deposit is to be made. As currency stored in a safe is only secure against unauthorized access, fire and other hazards when the door is securely locked, the situation as described is clearly undesirable.

In an attempt to overcome the limitations on the use of the standard safe, others have devised improvements that have met with varying degrees of success. One of the more common of such improvements involves the use of a mail-slot opening in the top or side of the safe. Such openings are structurally very similar to mail openings in doors that may be found on residential homes. These slots are sufficiently large to allow a bundle of currency to be inserted into the safe, but are sufficiently small to restrict the removal of currency through the opening.

A further improvement that has been employed is a variation of the mail-slot type structure. In this variation the safe, in addition to the normal access door, typically has a second opening on its top surface. Mounted over this opening is a revolving paddle-wheel type structure. In order to deposit the currency directly into the safe without opening the main access door, money is placed in the slot between two adjacent vanes in the revolving paddle-wheel. The wheel is then rotated until the slot containing the money corresponds with the opening in the top surface of the safe. At this point the money then falls from the slot into the interior portion of the safe. This improvement has the added advantage, over the mail-slot type opening, of preventing direct access to the contents of the safe through the opening on the upper surface.

The two improvements discussed, as well as variations suggested by others, all suffer from the inherent problem that the currency deposited through such secondary openings is randomly scattered throughout the interior of the safe. Accordingly, when it becomes time to empty the contents of the safe and transport them to either a larger holding facility or another location, the currency must be gathered up and put into some form of transferring receptacle. This process is time consuming and, the use of insecure transferring receptacles (which are most often cloth bags), exposes the currency to the risk of theft or damage from fire or other elements. Furthermore, currency may be lost or misplaced when being moved from the safe to a separate transferring receptacle.

Such devices also suffer from the problem of not having a precise and accurate account of the amount of money contained in the safe at any particular time. In order to keep track of the deposits made into the safe it is necessary for personnel making deposits to first count the money to be deposited and secondly to tabulate a record of each deposit. This procedure introduces the possibility of error through improper counting and through the failure of personnel to tabulate each and every deposit. The probability of error increases substantially in situations where numerous people are making a large number of deposits throughout the day. Each time the currency must be handled manually, the associated labour costs increase as does the potential for theft, damage, loss and calculation errors.

SUMMARY OF THE INVENTION

The invention therefore provides a currency receiving device which overcomes these disadvantages through the incorporation of a currency counter and a removable currency receptacle contained within the safe. The currency counter allows for an accurate totalling of each individual deposit made into the safe and also allows for a complete and accurate tabulation of all deposits made.

The advantage of the removable currency receptacle is that the currency that is deposited is placed directly into the receptacle (which is positioned within the safe) such that when the receptacle becomes full, or for some other reason its contents need to be transferred, the entire receptacle is merely removed from the safe without the need for personnel to handle the currency directly. The removable receptacle then provides a secure transport medium for its contents. Typically, the receptacle would be formed from heavy gauge steel.

The invention has the further advantage that it can be microprocessor controlled making it readily adaptable to the automated facilities used by financial and other institutions which deal with large volumes of currency. Use of the invention allows for convenient and accurate depositing of currency and also allows for simplified transport of the currency with minimal handling. Furthermore, in the event of a power shortage, the opening through which currency is deposited remains securely closed.

Accordingly, the present invention in one of its aspects provides a currency receiving device comprising, a safe having a lockable access opening for controlling entry into an interior of said safe and a lockable currency receiving opening; a removable currency receptacle contained within said safe and being positioned to receive currency introduced into said safe through said currency receiving opening; a currency counter for counting currency received and placing said currency in position to pass through said currency receiving opening; and, a controller governing the opening of said currency receiving opening upon said currency being in position.

In another aspect of the present invention, the removable currency receptacle includes a platform, which carries currency thereupon, and the safe includes a sensor for determining whether the carried currency is clear of the currency receiving opening. When the currency is clear of the currency receiving opening the sensor transmits a signal causing a reversible drive means to be de-energized. The sensor also operates to energize the reversible drive means to lower the platform when the currency is not clear of the currency receiving opening.

In a further aspect, the invention provides a currency receiving receptacle for use in a safe comprising an open ended canister, an internal currency carrying platform, and means to raise or lower said platform within said canister.

In yet another aspect the invention provides a method of counting and storing currency comprising the steps of placing a bundle of currency into a currency counter wherein activation of said currency counter causes said currency to be counted, tabulated, and placed in position to pass through a currency receiving opening in a safe, causing said currency to be introduced into said safe though said currency receiving opening; and, depositing and holding said currency in a removable currency receiving receptacle contained within said safe.

Further objects and advantages of the invention will become apparent from the following description, taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred/embodiments of the present invention in which.

DESCRIPTION OF PREFERRED EMBODIMENT

Figure 1:
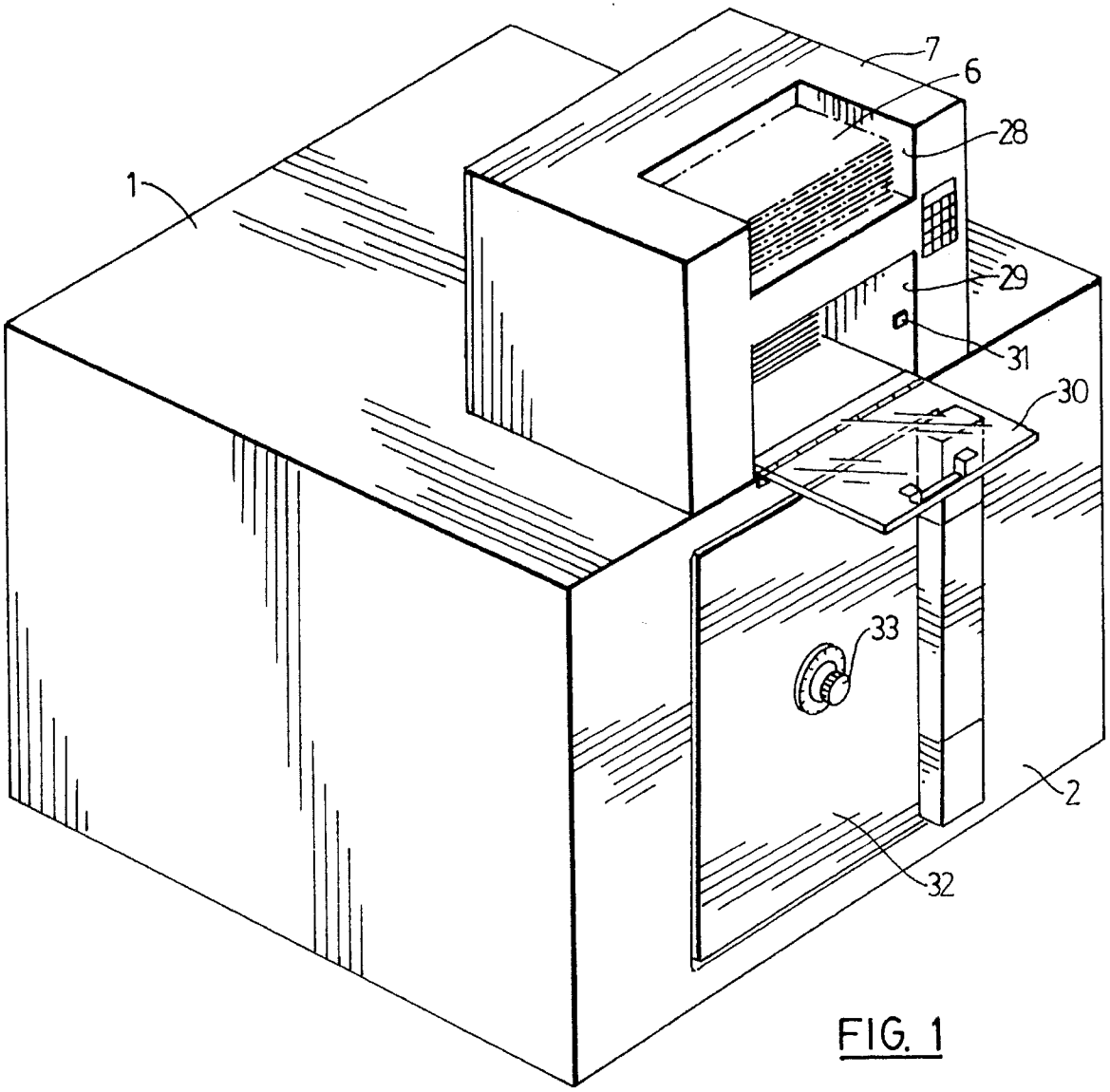
FIG. 1 is a perspective view of the currency receiving device of the present invention.

FIG. 1 shows a currency receiving device pursuant to the present invention (indicated generally at 1) comprised primarily of a safe 2, having a lockable access opening or door 32 with a lock 33, and a currency counter 7.

Figure 2:
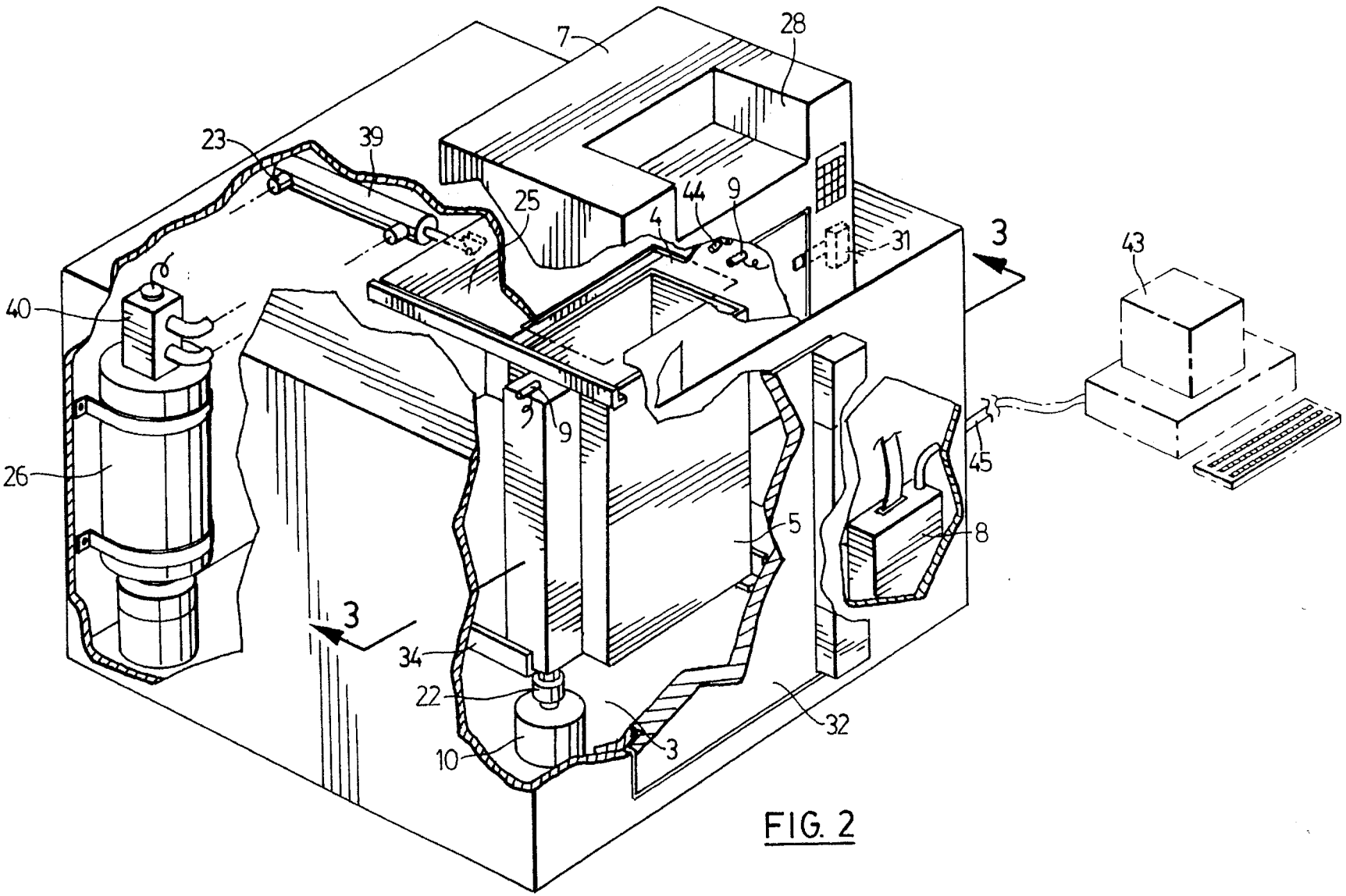
FIG. 2 is a partial cut-away view of FIG. 1 showing the internal mechanism of the currency receiving device.

In FIG. 2, portions of the outside surfaces of the currency receiving device 1 of FIG. 1 have been removed to expose the internal mechanisms. Held within the interior 3 of safe 2, with the aid of brackets 34, is a removable currency receptacle 5. The physical dimensions of the safe door 32 and the currency receptacle 5 are designed to allow the removal or insertion of the currency receptacle 5 into the safe 2.

Figure 3:
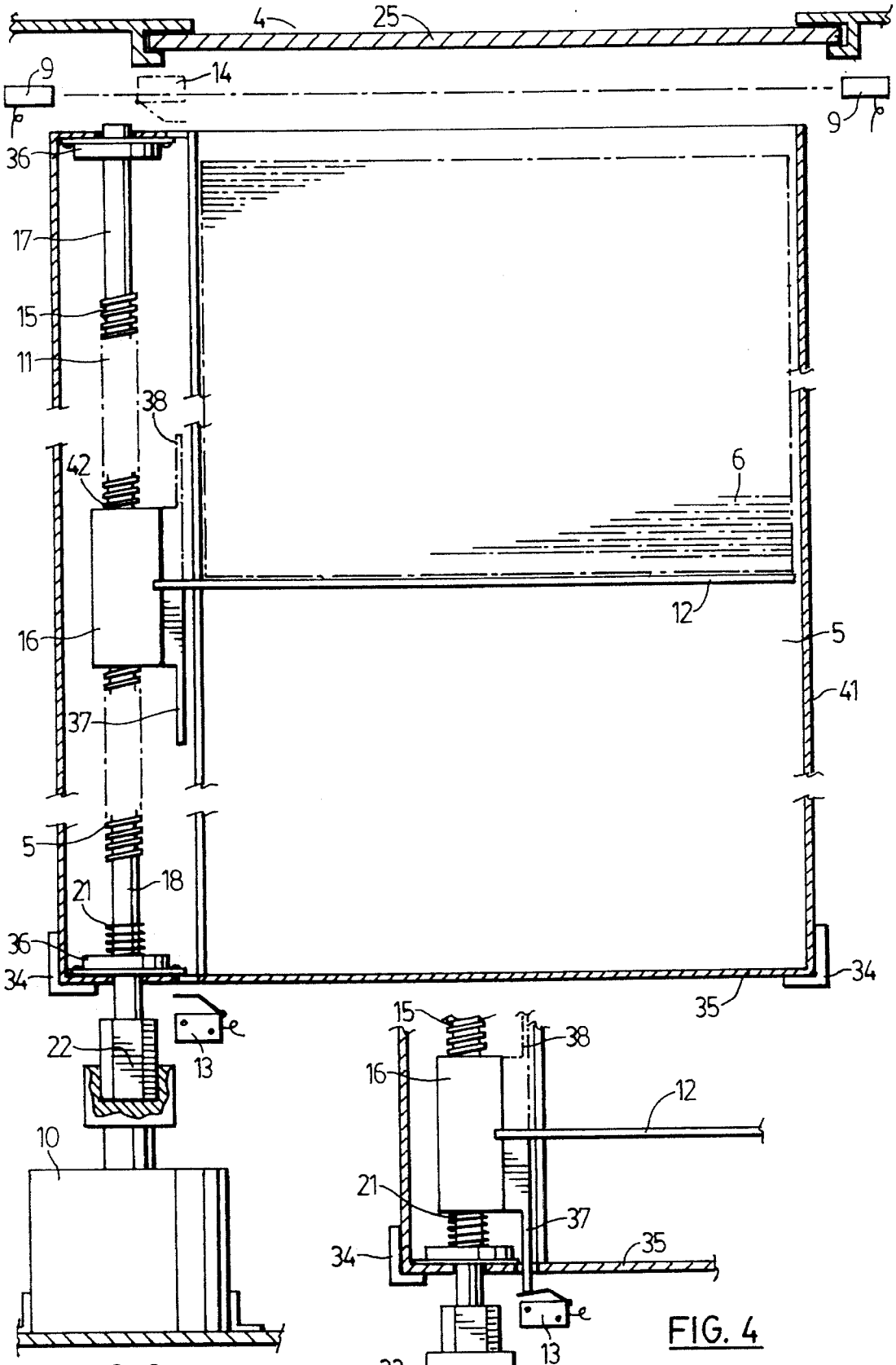
FIG. 3 is a cross-sectional view taken along the line 3—3 of FIG. 2; and, FIG. 4 is an enlarged view of the bottom portion of the shaft of FIG. 3 where the platform is in its bottom most position.

Currency receptacle 5 may be described generally as an open ended box-like structure as shown in FIGS. 2 and 3, however, configurations other than the box-like structure shown may also be employed without affecting the operation of the invention. Currency receptacle 5 comprises a canister 41 with an internal currency carrying platform 12 and means 42 to raise or lower platform 12 within receptacle 5.

In the preferred embodiment means 42 is a shaft 11 running generally vertically along one side of receptacle 5. Shaft 11 is secured within currency receptacle 5 through the use of bearings 36 which enable shaft 11 to freely rotate. One end of shaft 11 passes through and extends beyond the bottom surface 35 of currency receptacle 5. This extension of shaft 11 is connected to a reversible drive means 10. Preferably the reversible drive means 10 is an electric motor, however, it will be appreciated that other drive means, including pneumatic and hydraulic mechanisms, may be used in the alternative.

The connection between shaft 11 and reversible drive means 10 is a releasable coupling 22 which enables currency receptacle 5 to be readily inserted into or removed from safe 2. To remove the currency receptacle 5 it is necessary only to lift it from brackets 34, disengage releasable coupling 22 and slide currency receptacle 5 through the safe door 32.

Platform 12 is attached to a threaded element 16 which engages a helical thread 15 on shaft 11. Threaded element 16 has a corresponding helical thread such that when engaged with shaft 11, rotation of shaft 11 causes threaded element 16, and hence platform 12, to move in either an upwardly or downwardly direction depending upon the rotation of shaft 11. The upper most portion 17 of shaft 11 and the bottom most portion 18 of shaft 11 are unthreaded such that rotation of shaft 11 in either direction will not cause threaded element 16, and platform 12, to be forced beyond an upper most or bottom most position. Furthermore, threaded element 16 includes a pin 37 which engages a first switch 13 to disengage reversible drive means 10 when threaded element 16 and platform 12 attain a preselected bottom most position. A similar pin 38, located on threaded element 16, engages a second switch 14 in order to de-energize reversible drive means 10 when threaded element 16 attain a preselected upper most position.

Figure 4:
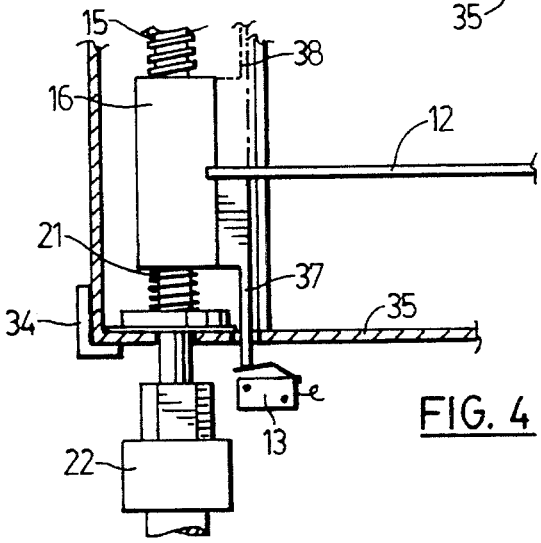

The unthreaded upper 17 and unthreaded lower 18 portions of shaft 11, together with the engagement of pins 37 and 38 with switches 13 and 14 respectively, limit the travel of platform 12 between a preselected bottom most and a preselected upper most position. For example, FIG. 4 shows platform 12 in its bottom most position wherein pin 37 has engaged first switch 13 to de-energize reversible drive means 10 and stop further rotation of shaft 11. FIG. 4 also shows a biaser 21 which assists threaded unit 16 to re-engage helical thread 15 once threaded element 16 has disengaged thread 15 and is situated over unthreaded lower portion 18. Typically biaser 21 would be a coil spring.

When removable currency receptacle 5 is placed within safe 2, it is situated immediately below lockable currency receiving opening 4. Currency receiving opening 4 is surmounted by currency counter 7.

Currency receiving device 1 also includes means 23 for closing currency receiving opening 4. In the preferred embodiment, means 23 consists of an actuator 39 and a moveable panel 25. The actuator 39 is connected to panel 25 to allow panel 25 to be moved between a position fully covering, and a position fully exposing currency receiving opening 4. Typically the actuator 39 would be a pneumatic cylinder, and preferably a double action pneumatic cylinder. However, it will be appreciated that other forms of actuators, including electric solenoids, could be employed to achieve the same effect and remain within the scope of the present invention.

In the situation where actuator 39 comprises a double action pneumatic cylinder, currency receiving device 1 would also contain a source of pressurized fluid 26 as a means of energizing the pneumatic cylinder. A control 40 on the source of pressurized fluid 26 governs the movement of actuator 39 and hence panel 25. In the embodiment shown in FIG. 2, the source of pressurized fluid 26 is an air compressor and the actuator 39 is a pneumatic cylinder.

The currency counter 7, which in FIG. 2 is shown situated on the upper surface of the currency receiving device 1, contains a currency receiving slot 28 and a currency removal slot 29. Currency removal slot 29 is normally covered by a hinged door 30. When opened, hinged door 30 activates a third switch 31 which de-energizes actuator 39 and prevents movement of panel 25.

Although the internal mechanisms of currency counter 7 are not identified in FIG. 2, currency counter 7 is of a standard off-the-shelf type, with appropriate modifications. Colour and pattern recognition sensors 44 are incorporated into currency counter 7 such that currency counter 7 is able to count, identify, and calculate the dollar value of a bundle of currency by analyzing reflected light patterns which are created by directing light at the currency to be identified and counted. An example of such a device which may be utilized in the present invention, with necessary physical modifications, is the commercially available BILLCON K212 Currency Counter.

The operations of the internal mechanisms of currency receiving device 1 are governed by a controller board or circuit 8. Typically, controller board or circuit 8 would work in conjunction with a computer or microprocessor 43 (shown in outline in FIG. 2) for overall control of the currency receiving device 1. The controller board 8 is coupled to the computer 43 through a communications link 45. The communications link 45 allows the currency receiving device 1 to be controlled by the computer 43. In one embodiment, the controller 8 is itself a microprocessor-based or "intelligent" circuit board, which receives and responds to commands from the computer 43. The computer 43 can be located at a remote site and is coupled to the controller 8 through the communications link 45, for example, a RS-232 serial link, as will be understood by one skilled in the art. In another embodiment, the controller 8 is an electronic circuit which is coupled directly to an output port, for example a parallel port, on the computer 45. In this embodiment, the computer 45 directly controls the operation of the controller 8 by issuing control signals on the parallel port interface. It will be appreciated that the second embodiment can provide a more economical implementation for the controller board 8, while the first embodiment provides an "intelligent" controller board 8 which can relieve the processing load for the computer 43 and also provide additional functionality.

Sensor 9, first switch 13, second switch 14, third switch 31, reversible drive means 10, and control 40 are coupled to the controller board 8 through a control interface. The controller board 8 uses the interface to regulate the operation of the sensor 9, first switch 13, second switch 14, third switch 31, reversible drive means 10 and actuator control 40. In the first embodiment, the interface 46 responds to control signals generated by a microprocessor on the controller board 8. In the second embodiment, the interface 46 responds directly to control signals generated by the computer 43.

Figure 5:
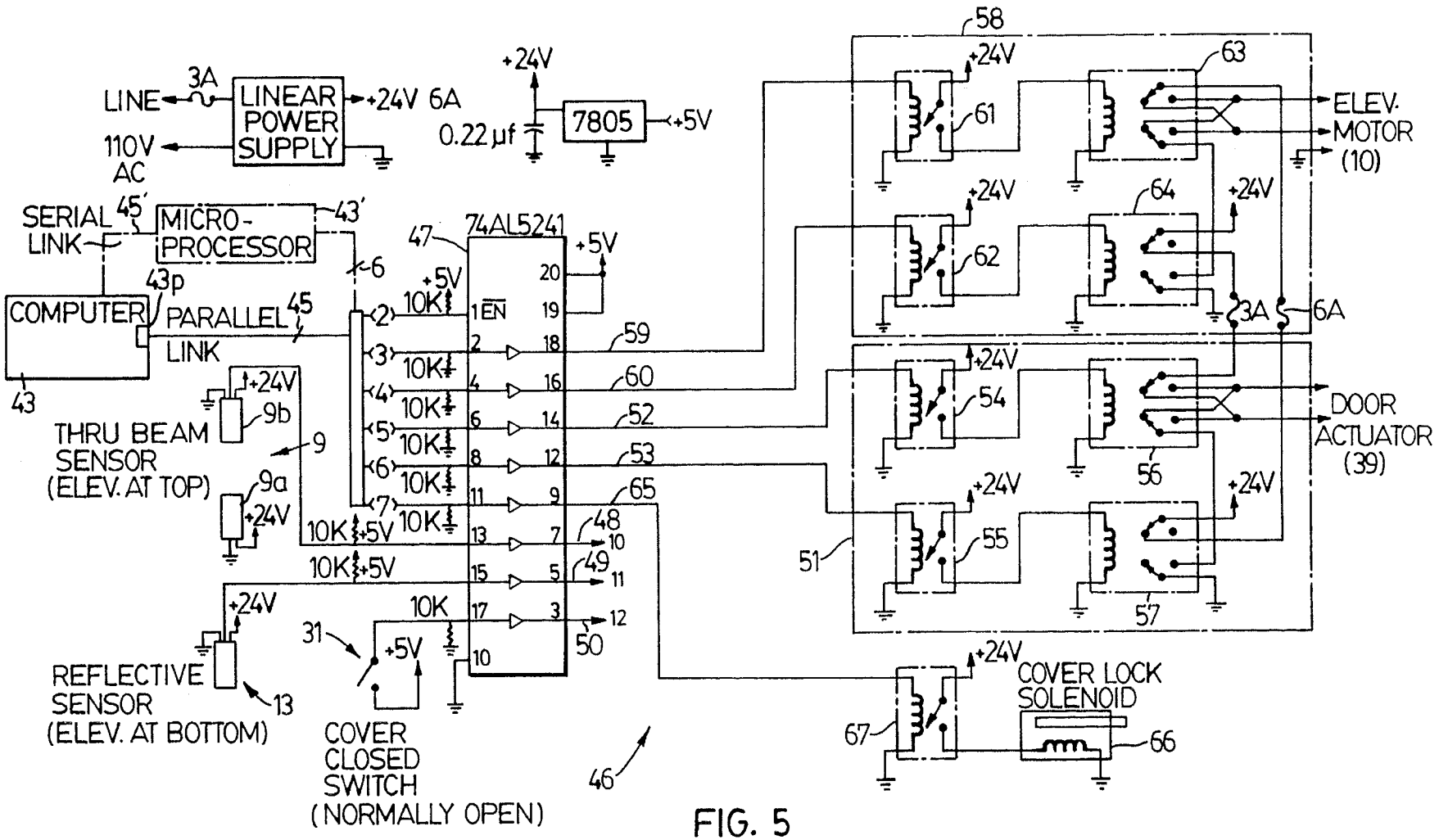
FIG. 5 is a schematic diagram of an interface circuit for the controller in the currency receiving device.

FIG. 5 shows an interface circuit 46 for the controller board 8. The interface 46 comprises a line driver chip 47 which is enabled by the controller 8. The line driver 47 provides a buffer for input/output lines to the controller 8. In the first embodiment, the line driver 47 can be memory-mapped or coupled to an input/output port of a microprocessor 43' on the controller board 8 which is coupled to the computer 43 through a serial communications link 45' as shown in broken outline in FIG. 5. In the second embodiment, the line driver 47 can be coupled directly to a parallel output port **43*p* on the computer 43 as shown in FIG. 5**.

As shown in FIG. 5, the driver 47 provides buffered inputs for the sensor 9 on line 48, for the first switch 13 on line 49, and the third switch 31 on line 50. The sensor 9 can comprise a light source **9*a*, e.g. a LED, and a photosensor 9*b*, e.g. photodiode or phototransistor. Currency falling through the opening 4 interrupts the beam produced by the light source 9*a* which is detected by reading the photosensor 9*b*. To read the input lines, the driver 47** is enabled (i.e. using input EN*), and the logic levels present on the input lines 48, 49 and 50 are read by the computer 43 through the port **43*p* (or by the microprocessor 43' on the controller board 8). The third switch 31 is implemented using a "normally open" switch. When the cover is opened, the switch 31 closes and this is detected by reading input line 50**.

The driver 47 also provides output lines which allow the computer 43 to regulate operation of the reversible drive means 10 and the door actuator 39. The door actuator 39 is controlled by a drive circuit 51 which is connected to output lines 52 and 53. The drive circuit 51 comprises first and second relays 54 and 55 which are connected to output lines 52 and 54. The first relay 54 couples output line 52 to a drive coil 56 which regulates the actuator 39 to open the panel 25. The second relay 56 couples a drive coil 58 to output line 54 which regulates the actuator 39 to close the panel 25. The reversible drive means 10, e.g. elevator motor, is controlled by a drive circuit 58 which is coupled to output lines 59 and 60. The drive circuit 58 comprises first and second relays 61 and 62 which are connected to output lines 59 and 60 respectively. The first relay 61 couples output line 59 to a drive coil 63 which regulates operation of the drive means 10 to raise the platform 12. The second relay 62 couples output line 60 to a second drive coil 64 which causes the drive means 10 to lower the platform 12. It will be appreciated that the drive circuits 51 and 58 depend on the type of actuator 39 and drive means 10 which are utilized.

As shown in FIG. 5, the interface circuit 46 also provides an output line 65 which controls a solenoid lock 66 for locking the panel 25. The solenoid lock 66 is coupled to the output line 65 through a relay 67. The computer 43 uses the relay 67 to lock and open the solenoid lock 66.

In both embodiments for the controller board 8, the electrical output from controller board 8 and currency counter 7 are received by computer 43, via the communication link 45 or 45', for analysis, storage and display of information. Ultimate control over the operation of currency receiving device 1 is through computer 43 where an operator's commands are electronically relayed to directly to the control interface 46, or through the microprocessor 43' on the controller board 8, to activate the internal mechanisms of the invention. Operation of the control interface 46 is controlled by a computer program, which can reside in firmware which is executed by the microprocessor 43', and software which is executed by the computer 43 to issue commands to the controller board 8 or directly control the interface 46. The computer program comprises routines for controlling the internal mechanisms of the currency receiving device 1 and communicating with the computer 43.

Figure 6:
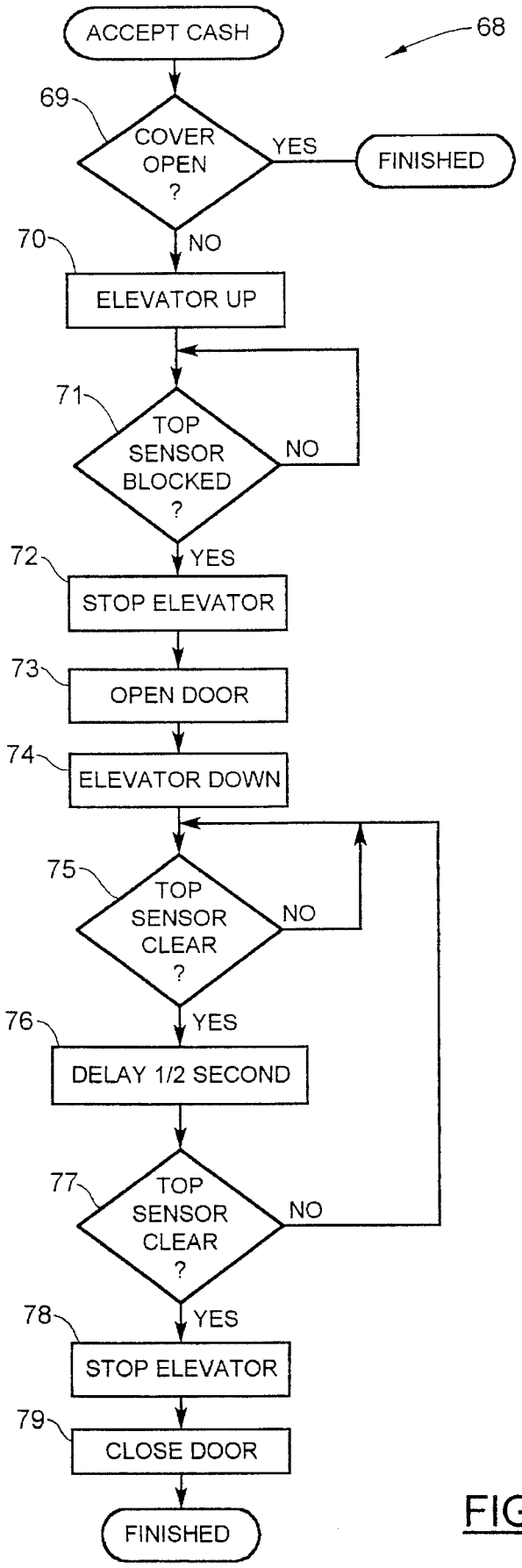
FIG. 6 is a flow chart showing the steps to accept cash by the currency receiving device according to the invention.

FIG. 6 shows in flow chart form the steps executed by a routine 68 in the computer program to accept cash 6. In operation, currency receptacle 5 is placed within safe 2. The computer 43 then activates reversible drive means 10 to position platform 12 at an upper point. A bundle of paper currency may then be inserted into receiving slot 28 of currency counter 7. Currency counter 7 is activated to count and optically identify the currency inserted and calculate a total dollar value. Once counted, currency counter 7 deposits the currency on top of panel 25 which, at that time, is fully covering currency receiving opening 4. If there should be a discrepancy between the amount of currency believed to have been inserted and the amount counted and calculated, the currency may be extracted through removal slot 29. In order to access removal slot 29, the door 30 must be opened thereby activating the third switch 31 to cause actuator 39 to be de-energized. This feature provides a safety function to ensure that an operator is not injured through the accidental movement of panel 25.

If there is no discrepancy in the amount of currency counted and calculated, and if it is desired to have the currency deposited within the safe 2, the actuator 39 is activated such that the currency receiving opening 4 is opened (block 69 in FIG. 6) allowing the currency 6 to fall into currency receptacle 5 and to be carried upon platform 12. If the platform 12 has not been positioned at an upper point, the output line 59 is activated to raise the platform 12 (block 70 in FIG. 6). Sensor 9 detects the currency falling into currency receptacle 5 and causes reversible drive means 10 to be activated such that platform 12 moves downwardly leaving more room for currency to be received (blocks 71 to 74 in FIG. 6). Once all currency has cleared the field of sensor 9, reversible drive means 10 is de-activated and actuator 39 moves panel 25 to close currency receiving opening 4 (blocks 75 to 79 in FIG. 6).

After a desired amount of currency has been deposited within currency receptacle 5, or when pin 37 activates switch 13 to indicate that platform 12 is at its preselected bottom most position, currency receptacle 5 can be removed. Currency receptacle 5 then provides a convenient and secure transport medium for which an accurate count has been made of the currency deposited. An additional empty currency receptacle may then be inserted or the original receptacle emptied and re-inserted to allow for further deposits.

It will be appreciated that currency counter 7 provides not only a means to determine the amount of currency deposited within the receiving device 1 but also identifies and differentiates between different denominations of currency. This allows for the amount of a deposit to be calculated when the deposit comprises currency of more than 1 denomination. In addition, currency counter 7 may be used independently for counting currency that is not to be deposited. In such cases the currency can be counted and then removed through slot 29 without being deposited.

Another advantage of the invention is that the actuator 39 is constructed such that, in the absence of power, panel 25 will remain in a position to fully cover currency receiving opening 4. This assists in the prevention of unauthorized access.

Still yet a further advantage is that computer 43 provides a means of constantly monitoring the amount of currency contained in receptacle 5. Computer 43 also provides a detailed record of the deposits made into receptacle 5 and, if connected to a printer, can provide a permanent record which can accompany receptacle 5 when transferred to another location.

It is to be understood that what has been described are the preferred embodiments of the invention and that it is possible to make variations to these embodiments while staying within the broad scope of the invention. Some of these variations have been discussed while others will be readily apparent to those skilled in the art to which this invention relates. For example, while reference has been made to a moveable panel 25, panel 25 could also be a hinged door. In addition, controller 8 and computer 43 could be combined into a single processing unit either integrated internally into currency receiving device 1 or connected externally.

The embodiments of the invention in which an exclusive property or privilege is claimed are defined as follows:

1. A currency receiving device comprising:

a safe having a lockable access opening for controlling entry into an interior of said safe and a currency receiving opening which includes a lockable moveable panel for opening and closing said currency receiving opening;

a removable currency receptacle contained within said safe and being positioned to receive currency introduced into said safe through said currency receiving opening;

a currency counter mounted outside of said lockable panel of said safe for counting and identifying currency received and for placing said counted currency in position to pass through said currency receiving opening, said externally mounted currency counter including, a currency removal slot for removing said counted currency prior to said counted currency being introduced into said safe through said currency receiving opening, a hinged door for covering said currency removal slot and a third switch associated with said hinged door; and a controller governing the opening of said moveable panel upon said counted currency being in position;

wherein said currency is counted, by said externally mounted currency counter, prior to said currency being introduced into said safe and said third switch prevents said moveable panel covering said currency receiving opening from moving when said hinged door is open.

2. The currency receiving device as claimed in claim 1 wherein said safe includes a sensor signalling said controller when said currency has been fully received within said currency receptacle.

3. The currency receiving device of claim 2 wherein said currency receiving opening is closed upon said currency being fully received within said currency receptacle.

4. The currency receiving device as claimed in claim 1 wherein said safe includes a reversible drive means and said currency receptacle includes a shaft connected to said reversible drive means.

5. The currency receiving device as claimed in claim 4 wherein said currency receptacle includes a platform attached to said shaft, said platform being moveable within said currency receptacle upon said shaft being driven by said reversible drive means.

6. The currency receiving device as claimed in claim 5 wherein said platform is moved in one direction upon said shaft been driven in a first direction and said platform is moved in an opposite direction when said shaft is driven in a second direction.

7. The currency receiving device as claimed in claim 6 wherein said currency receptacle includes a first switch to de-energize said reversible drive means upon said platform attaining a preselected bottom most position.

8. The currency receiving device as claimed in claim 7 wherein said currency receptacle includes a second switch to de-energize said reversible drive means upon said platform attaining a preselected upper most position.

9. The currency receiving device as claimed in claim 8 wherein said platform carries currency thereupon and said safe includes a sensor for sensing whether said carried currency is clear of said currency receiving opening, said sensor transmitting a signal to de-energize said reversible drive means upon said currency being clear of said currency receiving opening and to energize said reversible drive means upon said currency not being clear of said currency receiving opening.

10. The currency receiving device as claimed in claim 9 wherein said shaft includes a helical thread and said platform is connected to a threaded element engaging said shaft, and upon rotation of said shaft said threaded element and said shaft are caused to move either up or down.

11. The currency receiving device as claimed in claim 10, wherein said shaft extends beyond an upper end of said thread and said platform is not forced beyond said preselected upper most position through rotation of said shaft.

12. The currency receiving device as claimed in claim 11 wherein said shaft extends beyond a lower end of said thread and said platform is not forced beyond said preselected bottom most position through rotation of said shaft.

13. The currency receiving device as claimed in claim 12 wherein said currency receptacle further includes a biaser to cause said threaded element to remain in contacting engagement with said lower end of said thread when said platform is at said preselected bottom most position.

14. The currency receiving device as claimed in claim 13 wherein said connection between said reversible drive means and said shaft is a releasable coupling.

15. The currency receiving device as claimed in claim 14 wherein said reversible drive means is an electric motor.

16. The currency receiving device as claimed in claim 15 wherein said controller is a microprocessor.

17. A currency receiving device comprising:

a safe having a lockable access opening for controlling entry into an interior of said safe and a currency receiving opening which includes a lockable moveable panel for opening and closing said currency receiving opening;

a means for closing said currency receiving opening wherein said currency receiving opening will remain closed in the absence of power;

a removable currency receptacle contained within said safe and being positioned to receive currency introduced into said safe through said currency receiving opening;

a currency counter mounted outside of said lockable panel of said safe for counting and identifying currency received and for placing said counted currency in position to pass through said currency receiving opening, said externally mounted currency counter including, a currency removal slot for removing said counted currency prior to said counted currency being introduced into said safe through said currency receiving opening; a hinged door for covering said currency removal slot and a third switch associated with said hinged door; and a controller governing the opening of said moveable panel upon said counted currency being in position;

wherein said currency is counted, by said externally mounted currency counter, prior to said currency being introduced into said safe and said third switch prevents said moveable panel covering said currency receiving opening from moving when said hinged door is open.

18. The currency receiving device as claimed in claim 17 wherein said means for closing said currency receiving opening comprises an actuator connected to a moveable panel.

19. The currency receiving device as claimed in claim 18 wherein said actuator is a double action pneumatic cylinder connected to a source of pressurized fluid.

20. The currency receiving device as claimed in claim 19 wherein operation of said double action pneumatic cylinder causes said panel to move between a position fully covering said currency receiving opening and a position fully exposing said currency receiving opening.

21. The currency receiving device as claimed in claim 20 wherein said source of pressurized fluid is an air compressor.

22. The currency receiving device as claimed in claims 1,3,6,14,17 or 21 wherein said controller and said currency counter are electronically connected to a computer.

* * * * *